US005565134A

United States Patent [19]

Tanner et al.

[11] Patent Number: 5,565,134

[45] Date of Patent: Oct. 15, 1996

[54] METHOD FOR ENRICHING ROSIN ACIDS FROM A HARDWOOD-CONTAINING SULFATE SOAP

[75] Inventors: Teemu Tanner, Kerava; Jukka Koistinen, Helsinki, both of Finland

[73] Assignee: JPI Process Contracting Oy, Helsinki, Finland

[21] Appl. No.: 350,547

[22] Filed: Dec. 7, 1994

[30] Foreign Application Priority Data

Dec. 8, 1993 [FI] Finland ..... 935492

[51] Int. Cl.[6] ..... C11D 9/30; C11D 15/04; C11D 13/00; C11D 15/00

[52] U.S. Cl. ..... 530/220; 530/225

[58] Field of Search ..... 252/108, 118, 252/133, 142, 143, 158, 162, 174.25, 367, 368

[56] References Cited

U.S. PATENT DOCUMENTS

| | | | |
|---|---|---|---|
| 2,430,029 | 11/1947 | Pollak et al. | 260/97.5 |
| 2,866,797 | 12/1958 | Berry et al. | 260/397.25 |
| 3,691,211 | 9/1972 | Julian | 260/397.25 |
| 4,265,824 | 5/1981 | Koskenniska et al. | 260/397.25 |

*Primary Examiner*—Glenn A. Caldarola
*Assistant Examiner*—Patricia L. Hailey
*Attorney, Agent, or Firm*—Young & Thompson

[57] ABSTRACT

The invention relates to a method for enriching rosin acids from a hardwood-containing sulfate soap, in which the soap is partially acidified at a temperature higher than room temperature with an inorganic or organic acid so as to give the resulting mother liquid a pH of 4.5–7, thus enabling the rosin acids to be enriched from the soap into the fraction converted to the acid form, and the fatty acids to be enriched in the soap.

4 Claims, No Drawings

METHOD FOR ENRICHING ROSIN ACIDS FROM A HARDWOOD-CONTAINING SULFATE SOAP

FIELD OF THE INVENTION

The present invention relates to a method for enriching rosin acids from a hardwood-containing sulfate soap. The enrichment is achieved by selective acidification of the soap.

BACKGROUND OF THE INVENTION

In the production of chemical pulp from softwood by the alkaline, i.e. sulfate, process, wood extractives separate out on the surface of the black liquor in the form of sodium soap of fatty and rosin acids in the different steps of the chemical recovery cycle of the sulfate pulping process. Specifically in the Scandinavian countries hardwood, birch in particular, is often used along with softwood as raw material in pulping mills. While softwood contains both fatty and rosin acids, hardwood contains only fatty acids and additionally a greater amount of neutral substances than softwood.

When hardwood is used to prepare chemical pulp, soap or tall oil from softwood digestion is dosed into the cooking. This decreases the extractive content of the resulting chemical pulp, which is a significant pulp quality criterion. The hardwood extractives thus produce 'mixed birch soap', comprising sodium salts of fatty acids and neutral organic components, such as sterols. Since the soap is often derived from both softwood and hardwood, as stated above, the quality of the resultant tall oil in view of further refining is substantially impaired. Particularly the increased content of neutral substances and the lowered rosin acid content complicate distillation of the tall oil, lowering the yields and impairing the purity of the products and also increasing the formation of lower-value pitch.

The CSR (Crude Soap Refining) process has been proposed as a solution to the problem of distillation. In this method, the unsaponifiable neutral components are extracted with an organic solvent, i.e. hexane. Prior to the extraction, the soap must be demulsified with acetone. The process becomes more complex, since two components, acetone and hexane, are needed. Furthermore, it has been found that neutral components impairing the quality of fatty acid distillates still remain in the extracted soap. As such, the process is capable of lowering the proportion of neutral components and increasing the proportion of rosin acids.

The utility of the above extraction method is based on further refining of the neutral fraction produced. On the other hand, the resulting quality of the extracted birch oil is not considered satisfactory.

It is known that soap can be acidified into tall oil with sulphuric acid. The pH of the $Na_2SO_4$-containing mother liquid is about 3, at which the acidification is practically carried to completion. The tall oil obtained from hardwood cooking is characterized by a high fatty acid content and a low rosin acid content, which makes the further refining more difficult, as explained previously.

SUMMARY OF THE INVENTION

It is an object of the present invention to provide a method wherewith the above disadvantages relating to the further refining of tall oil, i.e. the low rosin acid content and the high content of neutral substances, can be obviated. It has now been unexpectedly found that this object is achieved when the fatty and rosin acid fractions of tall oil are enriched in separate fractions. This is achieved when the acidification of soap is carried out only in part. When soap is acidified with a sodium bisulfite solution, for example, the pH of the resulting mother liquid can be adjusted so as to effect only partial acidification. It has been found that when the pH drops to about 4.5–7, the rosin acid salts in the soap are converted to the free acid form, whereas the fatty acid salts remain unacidified. Thus enrichment of the acid form in terms of rosin acids is involved. It is apparent from the results in Table 1 hereinbelow that the enrichment factor is close to two. The same result is achieved by performing partial acidification with any other organic or inorganic acid so as to give the resulting mother liquid a pH of 4.5–7.

The invention thus relates to a method for enriching rosin acids from a hardwood-containing sulfate soap, characterized in that the soap is partially acidified at a temperature higher than room temperature with an inorganic or organic acid so as to give the resulting mother liquid a pH of 4.5–7, thus enabling the rosin acids to be enriched from the soap into the fraction converted to the acid form, and the fatty acids to be enriched in the soap, whereafter the rosin acid-enriched fraction converted to the acid form is separated from the resulting tall oil/soap mixture by extracting this with an organic solvent. Preferably the pH of the mother liquid is adjusted to the value 6–7. The partial acidification is preferably performed with a sodium bisulfite solution.

On the basis of this finding, the partially acidified soap can be treated in such a way that the rosin and fatty acids can be partly separated from the tall oil prior to its distilling. The process sequence is the following: The soap converted to acid and the unsaponified neutral components are extracted with an organic solvent (e.g. hexane) from the soap that has been partially acidified with sodium bisulfite. Thus the soap enriched in fatty acids and small amounts of unsaponified materials, which are particularly detrimental to the distillation of tall oil, remain in the soap form. This soap fraction enriched in fatty acids is converted to tall oil enriched in fatty acids by conventional methods, such as by means of sulfuric acid.

The organic phase extracted with a solvent is passed into solvent recovery, in which the solvent is separated from tall oil by evaporation. The evaporated solvent is condensed and reused. The product obtained is tall oil enriched in rosin acids, which is easier to distill than tall oil acidified by the presently employed methods.

DETAILED DESCRIPTION OF THE INVENTION

The invention is illustrated by the following examples.

Example 1

Fatty and rosin acids in tall oil

Industrial soap, wherefrom tall oil was produced by sulphuric acid acidification, was used in the test. The acid number of the tall oil was 153. The dosage of sulphuric acid was about 100 g $H_2SO_4$ (counted as 100% sulphuric acid)/kg of wet soap. In addition, dilution water was employed to facilitate separation of the sodium salt-containing mother liquid obtained in the splitting of soap. The tall oil content in the soap was 55.7% by weight. A sample was taken of the resulting tall oil, and the sample was extracted with ether. The rosin and fatty acid contents in this fraction of tall oil extracted with ether were measured by gas chromatography and are shown in Table 1.

Example 2

Fatty and rosin acids in soap oil

Partial acidification was performed on two soap batches with a $NaHSO_3$ solution in a closed reactor at 105° C. and at a maximum pressure of 100 kPa (1 bar). The pH of the spent $NaHSO_3$ solution obtained from a sulfate pulping plant was 5.86. The dose of $NaHSO_3$ solution in cooking No. 1 was 4200 g (100%) on the weight of the soap. In cooking No. 2, the dose was 1200 g (140%).

In the acidification, the above two batches of soap were heated with the $NaHSO_3$ solution to the reaction temperature of 105° C. with periodic stirring. Thereafter the reaction mixtures were reacted for 10 minutes with periodic stirring. The reaction gases were discharged and the reaction mixtures were allowed to stand for further 10 minutes, whereafter the mother liquid was separated through a drain valve. The pH of the mother liquid obtained in connection with soap batch No. 1 was 7.06, and the pH of the mother liquid obtained in connection with soap batch No. 2 was 6.78.

Both of the soap oil phases thus obtained were extracted with ether. The rosin and fatty acid contents of these fractions extracted with ether were measured by gas chromatography.

The contents of rosin and fatty acids that were soluble in ether, i.e. in the free acid form, in the tall oil obtained in Example 1 and the soap oils obtained in Example 2 are given in Table 1. The contents in soap oils are indicated as weight per cent of soap oil. Since ether has dissolved also neutral substances and water in the sample, a comparison of the relative contents of fatty and rosin acids in the extracts is also shown in the table. Table 1 also shows the relative enrichment factors of the different fractions, illustrating the enrichment of the given substance from the fatty and rosin acid fraction of tall oil into the fatty and rosin acid fraction of soap oil.

The results in the table show that the enrichment factor of rosin acids is close to 2.

TABLE 1

FATTY AND ROSIN ACID CONTENTS IN SOAP, TALL OIL AND SOAP OIL

| | wet soap (content) % by wt. | tall oil free acids % by wt. | FA + RA fraction in tall oil % by wt. | soap oil 1 free acids % by wt. (/soap oil) | FA + RA fraction in fraction extracted from soap oil 1 % by wt. | Enrichment factor | soap oil 2 free acids % by wt. (/soap oil) | FA + RA fraction in fraction extracted from soap oil 2 % by wt. | Enrichment factor |
|---|---|---|---|---|---|---|---|---|---|
| FATTY ACIDS | 0.051 | 0.098 | 0.137 | 0.020 | 0.093 | 0.68 | 0.010 | 0.065 | 0.47 |
| C15:0 | 0.040 | 0.076 | 0.106 | 0.010 | 0.047 | 0.44 | 0.010 | 0.065 | 0.81 |
| C15:1 | 0.089 | 0.171 | 0.238 | 0.030 | 0.140 | 0.59 | 0.020 | 0.129 | 0.54 |
| C16:0 | 1.424 | 2.728 | 3.807 | 0.550 | 2.565 | 0.67 | 0.430 | 2.650 | 0.70 |
| C16:1 | 0.128 | 0.246 | 0.343 | 0.050 | 0.233 | 0.68 | 0.030 | 0.194 | 0.57 |
| C17:0 ai | 0.211 | 0.404 | 0.563 | 0.080 | 0.373 | 0.66 | 0.050 | 0.323 | 0.57 |
| C18:0 | 0.522 | 1.000 | 1.395 | 0.180 | 0.640 | 0.60 | 0.000 | 0.000 | 0.00 |
| C18:1 | 5.092 | 9.750 | 13.607 | 2.460 | 11.474 | 0.64 | 1.900 | 12.282 | 0.90 |
| C18:1 | 0.232 | 0.444 | 0.620 | 0.110 | 0.513 | 0.83 | 0.080 | 0.517 | 0.83 |
| C18:2 | 0.147 | 0.281 | 0.392 | 0.050 | 0.233 | 0.59 | 0.040 | 0.259 | 0.66 |
| C18:2 | 13.228 | 25.331 | 35.350 | 6.290 | 29.338 | 0.83 | 4.680 | 30.252 | 0.86 |
| C18:3 | 1.669 | 3.196 | 4.460 | 0.700 | 3.265 | 0.73 | 0.510 | 3.297 | 0.74 |
| C18:3 | 0.499 | 0.955 | 1.333 | 0.180 | 0.840 | 0.63 | 0.130 | 0.840 | 0.63 |
| tot conj 18:2 | 1.252 | 2.398 | 3.346 | 0.810 | 3.778 | 1.13 | 0.620 | 4.008 | 1.20 |
| tot conj 18:3 | 2.320 | 4.443 | 6.200 | 0.310 | 1.446 | 0.23 | 0.210 | 1.357 | 0.22 |
| tot 20:3 | 0.951 | 1.822 | 2.542 | 0.450 | 2.099 | 0.83 | 0.610 | 3.943 | 1.55 |
| C22:0 | 0.525 | 1.006 | 1.404 | 0.050 | 0.233 | 0.17 | 0.040 | 0.259 | 0.18 |
| C24:0 | 0.292 | 0.559 | 0.780 | 0.000 | 0.000 | 0.00 | 0.000 | 0.000 | 0.00 |
| others | 0.220 | 0.421 | 0.568 | 0.220 | 1.026 | 1.75 | 0.120 | 0.776 | 1.32 |
| TOTAL FATTY ACIDS | 28.892 | 55.327 | 77.210 | 12.610 | 58.815 | 0.76 | 9.700 | 62.702 | 0.81 |
| ROSIN ACIDS | | | | | | | | | |
| Pimaric acid | 1.013 | 1.939 | 2.707 | 0.830 | 3.871 | 1.43 | 0.590 | 3.814 | 1.41 |
| sandaracopimaric a. | 0.202 | 0.388 | 0.541 | 0.150 | 0.700 | 1.29 | 0.110 | 0.711 | 1.31 |
| palustric acid | 1.188 | 2.275 | 3.175 | 1.580 | 7.369 | 2.32 | 0.960 | 6.206 | 1.95 |
| levopimaric acid | 0.322 | 1.250 | 1.745 | 0.520 | 2.425 | 1.39 | 0.390 | 2.521 | 1.45 |
| isopimaric acid | 0.653 | 1.250 | 1.745 | 0.520 | 2.425 | 1.39 | 0.390 | 2.521 | 1.45 |
| abietic acid | 2.225 | 4.260 | 5.945 | 2.750 | 12.826 | 2.16 | 1.770 | 11.441 | 1.92 |
| dehydroabietic acid | 2.101 | 4.024 | 5.615 | 1.200 | 5.597 | 1.00 | 1.160 | 7.498 | 1.34 |
| neoabietic acid | 0.414 | 0.794 | 1.107 | 1.300 | 6.063 | 5.48 | 0.650 | 4.202 | 3.79 |
| dehydrodehydroabietic acid | 0.409 | 0.784 | 1.094 | 0.000 | 0.000 | 0.00 | 0.000 | 0.000 | 0.00 |
| TOTAL ROSIN ACIDS | 8.528 | 16.331 | 22.790 | 8.830 | 41.185 | 1.81 | 5.770 | 37.298 | 1.64 |
| TOTAL FA + RA | 37.420 | 71.658 | 100.000 | 21.440 | 100.000 | 1.00 | 35.470 | 100.000 | 1.00 |

FA + RA fraction = fatty acid + rosin acid fraction

We claim:

1. A method for enriching rosin acids from a sulfate soap containing hardwood extractives, comprising: partially acidifying the soap at a temperature higher than room temperature with an inorganic acid comprised of a sodium bisulfite solution so as to give the resulting mother liquid a pH of 4.5–7, thereby enabling the rosin acids to be enriched from the soap into the fraction converted to the acid form, an the fatty acids to be enriched in the soap, and thereafter separating the rosin acid-enriched fraction converted to the acid form from the resulting tall oil/soap mixture by extracting the tall oil/soap mixture with an organic solvent extractant.

2. A method as claimed in claim 1, wherein the mother liquid has a pH of 6–7.

3. A method as claimed in claim 1, wherein ether is employed as the extractant.

4. A method as claimed in claim 1, further comprising separating the extractant from the tall oil by evaporation, and condensing and reusing evaporated solvent to extract an organic acid fraction.

* * * * *